US006055908A

United States Patent [19]

Van Der Horst

[11] Patent Number: 6,055,908

[45] Date of Patent: May 2, 2000

[54] METHOD AND DEVICE FOR POSITIONING PRINTING PLATES

[75] Inventor: Hans Van Der Horst, Rijnsaterwoude, Netherlands

[73] Assignee: AV Flexologic B.V., Netherlands

[21] Appl. No.: 09/198,341

[22] Filed: Nov. 24, 1998

[30] Foreign Application Priority Data

Nov. 27, 1997 [NL] Netherlands ..... 1007631

[51] Int. Cl.[7] ..... B41B 11/00

[52] U.S. Cl. ..... 101/486; 101/DIG. 36; 101/477; 33/621

[58] Field of Search ..... 101/415.1, 477, 101/486, DIG. 36, 483, 485, 484; 33/615, 616, 617, 621, 623

[56] References Cited

U.S. PATENT DOCUMENTS

| | | | |
|---|---|---|---|
| 3,873,202 | 3/1975 | Inoue | 355/88 |
| 4,707,930 | 11/1987 | Sugiura et al. | 33/623 |
| 5,660,110 | 8/1997 | Klang | 101/415.1 |
| 5,809,894 | 9/1998 | Goldstein | 101/486 |
| 5,850,789 | 12/1998 | Rudolf et al. | 101/486 |

FOREIGN PATENT DOCUMENTS

| | | | |
|---|---|---|---|
| 3-86579 | 4/1991 | Japan | 101/DIG. 36 |
| 2 031 341 | 4/1980 | United Kingdom | 101/DIG. 36 |

OTHER PUBLICATIONS

Schuster et al., "Microscope Inspection System," Xerox Disclosure Journal, vol. 1, No. 2, Feb. 1976.

*Primary Examiner*—Christopher A. Bennett
*Attorney, Agent, or Firm*—Banner & Witcoff, Ltd.

[57] ABSTRACT

The invention relates to a method and device for positioning a flexible printing plate in a desired position on a flexible carrier arranged on a table, the method comprising the steps of placing the printing plate at a first easily accessible position on the table and subsequently moving the printing plate from the first position to the desired position on the flexible carrier in accordance with a predetermined direction and distance; and wherein the device comprises a flat table, means for positioning the flexible carrier, means for determining the location of the carrier in a first easily accessible position, and transporting means for transferring the printing plate from the first position to the predetermined position on the flexible carrier.

15 Claims, 1 Drawing Sheet

METHOD AND DEVICE FOR POSITIONING PRINTING PLATES

Figure 1:
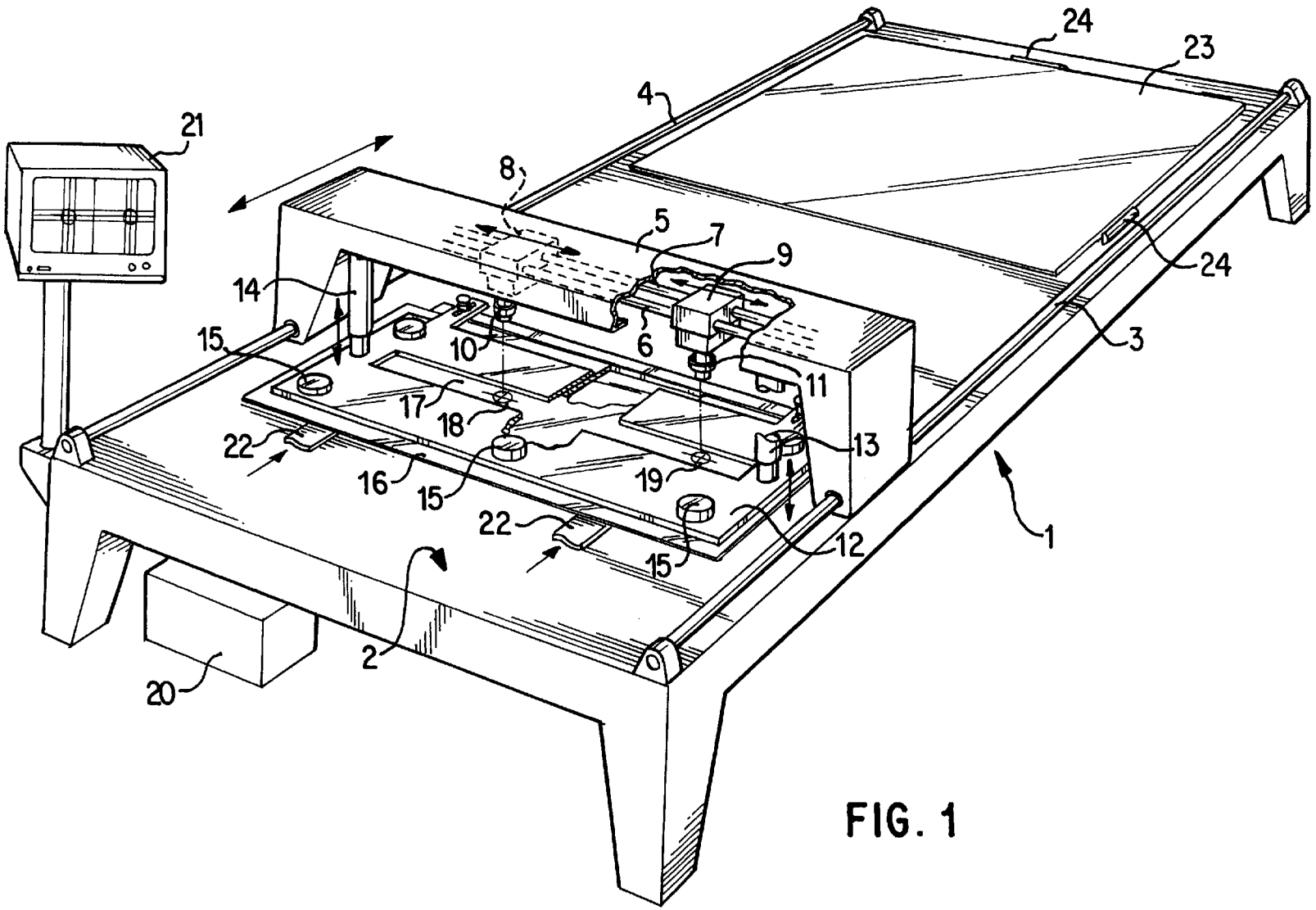

The invention relates to a method for positioning a flexible printing plate on a flexible carrier.

According to the prior art a flexible printing plate is positioned on a flexible carrier arranged on a format cylinder. The flexible carrier is subsequently taken off the format cylinder and placed on the printing cylinder, whereafter the printing operations can be performed.

Precise positioning of a flexible printing plate on such a format cylinder is a laborious task which must be carried out with the necessary accuracy and which requires expertise, manual skill and patience. Nor is it possible to perform this placing in automated manner.

The object of the present invention is to provide such a method and a device for use therein, wherein the drawbacks of the prior art, i.e. the long time period required, the required precision and manual skill, are avoided and wherein the positioning can easily be performed in automated manner.

This object is achieved by a method for positioning a flexible printing plate in a desired position on a flexible carrier arranged on a table, comprising the following steps of:

placing the printing plate at a first easily accessible position on the table; and subsequently moving the printing plate from the first position to the desired position on the flexible carrier in accordance with a predetermined direction and distance.

This object is also achieved by a device for positioning a flexible printing plate in a desired position on a flexible carrier arranged on a table, wherein the device comprises:

a flat table;

means for positioning the flexible carrier;

means for determining the location of the carrier in a first easily accessible position; and transporting means for transferring the printing plate from the first position to the predetermined position on the flexible carrier.

By using a flat table it becomes possible to arrange the flexible printing plate manually at a defined position and to then displace it, in a manner which may or may not be automated, from this defined position to the final desired position.

There are in principle two different options here.

It is possible, prior to displacing of the printing plate, for the printing plate to be accurately positioned at the first position on the table using positioning means. The positioning means can herein be formed by a stop or a series of stops or by electronic positioning means, for instance aligning crosses projected by means of a light source or by means of video cameras and monitors coupled thereto on which aligning crosses are situated, wherein markings arranged on the printing plate must be placed in register with the aligning crosses.

The other option in principle is to arrange the flexible printing plate in the first position, whereafter the precise position of this printing plate is determined, for instance by means of electronic assist means.

It is then possible to calculate over which distance and in which direction the printing plate must be displaced in order to reach the finally desired position on the flexible carrier.

The device according to the invention is provided for this purpose with the measure that the means for determining the location of the printing plate in the first position comprise recording means for registering the position of markings arranged on the printing plate.

According to a further embodiment, such a device comprises calculating means for calculating the distance and the direction over which the printing plate must be displaced to reach the desired position on the flexible carrier.

According to another embodiment the device comprises at least one stop for placing the printing plate in its first position.

Other attractive preferred embodiments are specified in the remaining sub-claims.

The present invention will be elucidated hereinbelow with reference to the annexed FIG. 1 which shows a partly broken-away, schematic perspective view of a device according to the invention.

FIG. 1 shows a table 1 which is provided with a flat top surface 2.

The table is provided with two rails 3,4 extending along the top surface in longitudinal direction of the table. A bridge 5 extending substantially in transverse direction of the table is movable along both rails 3,4 in the longitudinal direction of the table. Bridge 5 is provided with two rails 6,7 extending in longitudinal direction of the bridge and therefore in transverse direction of the table.

Mounted on the rails are two video cameras 8,9 which are movable along rails 6,7. Video cameras 8,9 are both provided with a downward directed lens 10 respectively 11.

The bridge is further provided with a pick-up device. The pick-up device is formed by a plate 12 which is connected by means of suspension elements 13,14 to elements which are not shown in the drawing and which are movable along rails 6,7.

The plate is provided for instance with suction cups 15 with which a flexible printing plate 16 present under the plate can be fixed to the plate. Further arranged in plate 12 is a slot 17 through which markings 18 respectively 19 arranged on printing plate 16 are visible to the lenses 10,11 of video cameras 8,9.

For driving of the bridge along rails 3,4 an electric motor, not shown in the drawing, is arranged in bridge 5, while both video cameras 8,9 are likewise provided with an electric motor, not shown in the drawing, for the movement along rails 6,7.

The same applies for the elements, not shown in the drawing, with which the pick-up device is movable along rails 6,7.

It will be apparent that other drives can be used, for instance with toothed belts, instead of the electric motors incorporated in the movable parts.

A computer 20 is arranged for control of the drives of bridge 5, video cameras 8,9 and the pick-up device, while the table is further provided with a monitor 21 which is adapted to display the image of both video cameras 8 respectively 9. The signals from the video cameras are also fed to the control device 20.

Finally, table 1 is provided at an easily accessible position with two stops 22 with which the location of the printing plate for positioning can be precisely defined.

A sheet carrier 23 is finally arranged on the other side of a table. Positioning means 24 known in the art can be located on the top surface 2 of the table 1 for positioning the sheet carrier 23.

The operation of the device according to the present invention will now be described, in addition to the method according to the present invention.

The invention particularly applicable in the positioning of flexible printing plates on flexible carriers which must then be arranged round pressure cylinders.

The positioning of the flexible printing plate on the carrier must herein take place as precisely as possible in respect of the required accuracy of registering of the produced printed work, particularly when polychrome printing is being applied.

Use is made for this purpose of the method according to the present invention, wherein according to a first embodiment a flexible printing plate 16 is positioned on the easily accessible part of the top surface of table 2 and against stops 22. In addition, use is preferably made of stops, not shown in the drawing, in order to also define the location of the printing plate at the side.

Once the printing plate has been placed at a given position, the printing plate can be gripped using the pick-up device, moved upward by means of suspension elements 13,14 and be further displaced in longitudinal direction of the table and possibly in transverse direction of the table to the correct position on flexible carrier 23. Use is made herein of the fact that it is known in which position the printing plate is situated initially and the position toward which the printing plate must be moved is also known, so that the distance and the direction can be calculated. The pick-up device subsequently moves the printing plate downward at its correct position and releases the printing plate.

It will be apparent that in this embodiment of the method the video cameras 8,9 are not used. It is however possible to use these to precisely define the location of the printing plate at the final position.

It is however also possible to position the printing plate accurately in another manner. It is here that use is in fact made of the video cameras. For this purpose the printing plate is placed on the relevant side of the table without using stops 22, whereafter the precise position of the aligning crosses 18,19 is determined using the video cameras; use is preferably made herein of monitor 21. It is however also possible to make use herein of other, automatically operating positioning devices.

It is thus possible to determine the precise location of printing plate 16 on the basis of the position of the aligning crosses, whereafter it is possible to calculate over which distance and in which direction, and possibly through which angular displacement, the printing plate must be transported. It is pointed out here that in the embodiment shown in the drawing there are no rotation options; it will be apparent however that these can be arranged and that the invention also comprises such rotation devices for the printing plate.

With the two above mentioned embodiments an easy method and device is thus obtained for precise positioning of printing plates on flexible carriers.

I claim:

1. Method for positioning a flexible printing plate in a desired position on a flexible carrier arranged on a table, comprising the following steps of:

a) placing the printing plate at a first easily accessible position on the table; and b) subsequently moving the printing plate from the first position to the desired position on the flexible carrier in accordance with a predetermined direction and distance.

2. Method as claimed in claim 1, wherein said placing step includes precisely positioning the printing plate at the first position on the table using positioning means prior to said printing plate being moved.

3. Method as claimed in claim 1, further including the steps of determining a location of the printing plate in the first position and calculating the direction and distance over which the printing plate must thereafter be displaced in order to arrive at said desired position, prior to said printing plate being moved.

4. Device for positioning a flexible printing plate in a desired position on a flexible carrier arranged on a table, wherein the device comprises:

a) a flat table;

b) means for positioning the flexible carrier;

c) means for determining the location of the carrier in a first easily accessible position; and d) transporting means for transferring the printing plate from the first position to the desired position on the flexible carrier.

5. Device as claimed in claim 4, characterized in that the means for determining the location of the printing plate in the first position comprise recording means for registering the position of markings arranged on the printing plate.

6. Device as claimed in claim 5, characterized by calculating means for calculating the distance and the direction over which the printing plate must be displaced to reach the desired position on the flexible carrier.

7. Device as claimed in claim 4, characterized in that the device comprises at least one stop for placing the printing plate in its first position.

8. Device as claimed in claim 5, characterized in that the recording means comprise at least one video camera which is placed in order to record a marking arranged on the printing plate.

9. Device as claimed in claim 8, characterized in that the at least one video camera is movable in a plane extending parallel to the table.

10. Device as claimed in claim 4, characterized in that the device comprises a transporting member for picking up, displacing in the horizontal plane and setting down the flexible printing plate.

11. Device as claimed in claim 5, characterized in that the device comprises a transporting member for picking up, displacing in the horizontal plane and setting down the flexible printing plate.

12. Device as claimed in claim 6, characterized in that the device comprises a transporting member for picking up, displacing in the horizontal plane and setting down the flexible printing plate.

13. Device as claimed in claim 7, characterized in that the device comprises a transporting member for pickling up, displacing in the horizontal plane and setting down the flexible printing plate.

14. Device as claimed in claim 8, characterized in that the device comprises a transporting member for picking up, displacing in the horizontal plane and setting down the flexible printing plate.

15. Device as claimed in claim 9, characterized in that the device comprises a transporting member for picking up, displacing in the horizontal plane and setting down the flexible printing plate.

* * * * *